US008701722B2

(12) United States Patent
Clüsserath

(10) Patent No.: US 8,701,722 B2
(45) Date of Patent: Apr. 22, 2014

(54) PRODUCTION INSTALLATION FOR FILLING WITH PRODUCTS RESPECTIVELY IN THE FORM OF A LIQUID FILLING MATERIAL AND BUFFER STORE FOR SUCH A PRODUCTION INSTALLATION

(75) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 323 days.

(21) Appl. No.: 13/144,982

(22) PCT Filed: Mar. 18, 2010

(86) PCT No.: PCT/EP2010/001716

§ 371 (c)(1),
(2), (4) Date: Jul. 18, 2011

(87) PCT Pub. No.: WO2010/115510

PCT Pub. Date: Oct. 14, 2010

(65) Prior Publication Data

US 2011/0277879 A1 Nov. 17, 2011

(30) Foreign Application Priority Data

Apr. 9, 2009 (DE) ..... 10 2009 016 806

(51) Int. Cl.
*B65B 1/04* (2006.01)
*B65B 31/00* (2006.01)
*B67C 3/02* (2006.01)
*B67C 3/22* (2006.01)

(52) U.S. Cl.
USPC ..... 141/98; 141/54; 141/57; 141/100

(58) Field of Classification Search
USPC ..... 141/52, 54, 57, 98, 100, 103
See application file for complete search history.

(56) References Cited

U.S. PATENT DOCUMENTS

| | | | | |
|---|---|---|---|---|
| 2,897,082 | A * | 7/1959 | Kaiser | 426/399 |
| 3,319,657 | A * | 5/1967 | Nyiri | 138/27 |
| 5,952,031 | A * | 9/1999 | Fischer | 426/590 |
| 6,467,497 | B1 * | 10/2002 | Stradinger et al. | 137/205 |
| 2007/0193652 | A1 * | 8/2007 | Till et al. | 141/144 |
| 2007/0272327 | A1 * | 11/2007 | Lin | 141/286 |
| 2012/0012226 | A1 * | 1/2012 | Runge et al. | 141/9 |

* cited by examiner

*Primary Examiner* — Timothy L Maust
*Assistant Examiner* — Brandon J Warner
(74) *Attorney, Agent, or Firm* — Occhiuti & Rohlicek LLP

(57) ABSTRACT

The invention relates to a production installation for filling bottles or similar containers with products in the form of a liquid filling material. The installation includes a device for providing a product, a filling machine connected to the device by at least one product line for filling the container with the product, and at least one buffer store connected to the product line and forming a storage space for the product.

27 Claims, 3 Drawing Sheets

Figure 1:
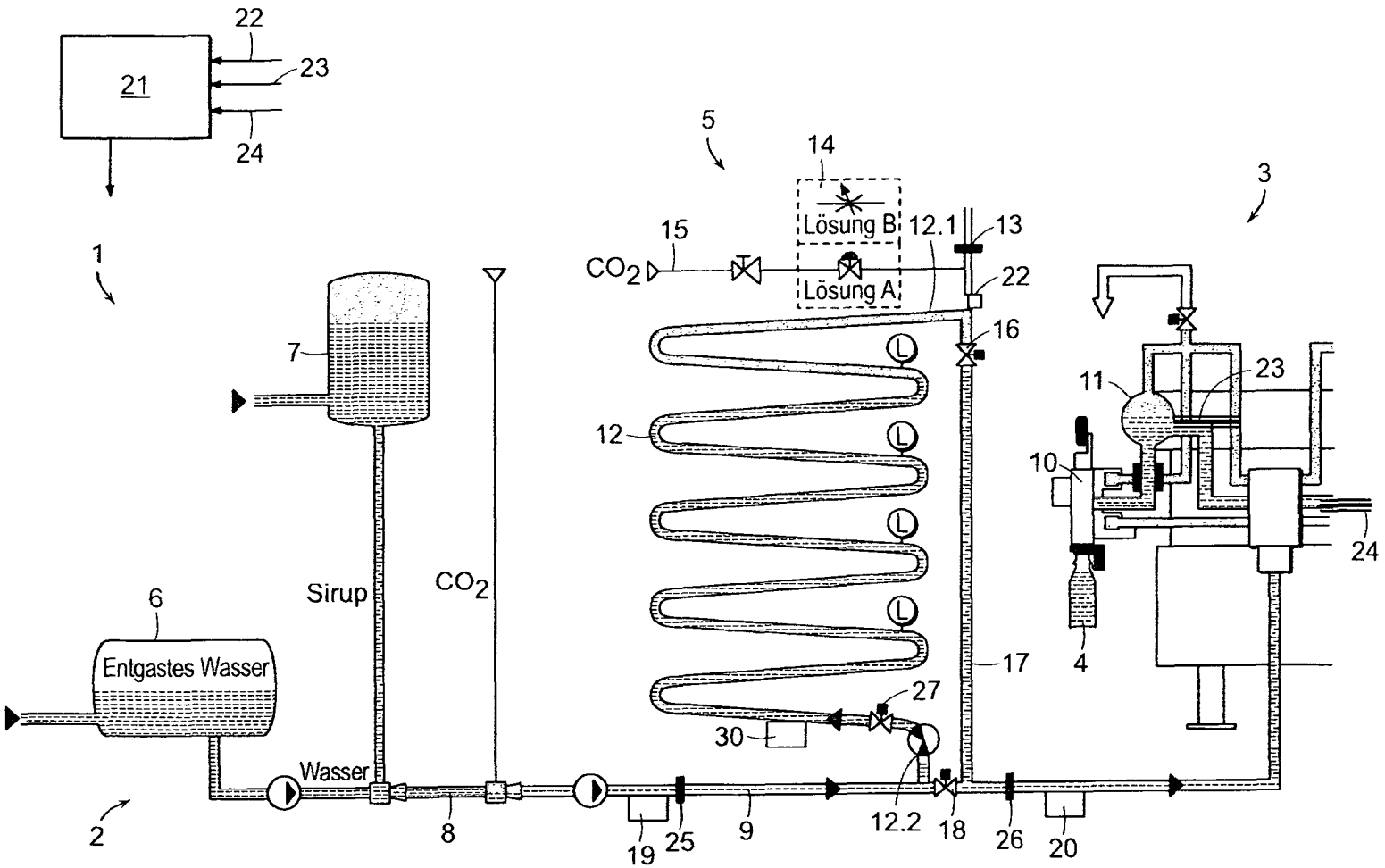

PRODUCTION INSTALLATION FOR FILLING WITH PRODUCTS RESPECTIVELY IN THE FORM OF A LIQUID FILLING MATERIAL AND BUFFER STORE FOR SUCH A PRODUCTION INSTALLATION

CROSS-REFERENCE TO RELATED APPLICATIONS

This application is the National Stage of International Application No. PCT/EP2010/001716, filed on Mar. 18, 2010, which claims the priority of German Patent Application No. 10 2009 016 806.0, filed on Apr. 9, 2009. The contents of both applications are hereby incorporated by reference in their entirety.

The invention relates to a production installation including an apparatus for use in connection with filling liquid product into containers.

Production installations for the filling of products in the form of a liquid filling material, for example in the form of a beverage, are known in a wide variety of different embodiments and usually consist of an installation for providing the product, at least one filling machine serving to fill the containers with the product and connected by at least one product line with the installation for providing the product, as well as at least one buffer store or buffer container which is connected by its inlet and outlet to the product line for the controlled acceptance, buffer storage and delivery of the product to the product line and/or to the filling machine. The installation for providing the product is for example a mixing installation in which the product (beverage) is manufactured by mixing with suitable mixing and proportioning systems from a plurality of components, for example water as base component, cordial and carbon dioxide. This is then buffered for example in the buffer store and fed from there to the filling machine.

In the case of special products, e.g. beer, juice or dairy products, the installation for providing the product is for example a pasteurizer or high temperature/short time system (HTST system for short) in which the product is short-time heated or pasteurised for sterilisation. The upstream installation for providing the product can also be alternatively or additionally a filter system.

The product so treated is then also buffered in the buffer container from where it is fed to the filler. The size and/or storage capacity of such a buffer store formed by a large-volume buffer tank in known installations is of the order of magnitude of between approx. 1500 and 30000 litres depending on the application and design rating.

The use of a buffer store is necessary for a number of reasons:

1. The buffer store acts as a pressure and/or surge compensator between the installation for providing the product and the filling machine. Process-engineering-related pressure peaks in the product are equalised by the buffer store and/or by a pressurised inert gas cushion or inert gas buffer permanently acting and/or present in the buffer store.
2. Upon not only the startup of a production installation and/or installation for providing the product, but also upon a change of production rate of the production installation, there occur within the mixing system product phases or product quantities with insufficient proportioning accuracies, i.e. with a mixture deviating from the nominal recipe, and which can also in particular exhibit variances of flavour or alterations which can be perceived by consumers. By buffer storing the product in the large-volume buffer tank, such product quantities that result from the startup or a change of production rate of the installation for providing the product and that deviate from the nominal recipe are mixed with product which exhibits the nominal mixture or nominal recipe, with the result that the product that is actually filled into the containers has no impairments, including as regards flavour quality.
3. A buffer store in the form of a large-volume buffer tank also allows a discontinuous production operation, i.e. in particular a discontinuous production rate of the installation for providing the product and/or a discontinuous acceptance rate of the filling machine. In particular, at least temporary variations in the production rate of the installation for providing the product and the acceptance rate of the filler machine can be equalised.
4. In the case of production installations which have an HTST system for providing the product, it is for example customary when the filling machine is stopped for product present in the HTST system to be circulated several times across the heating device of this HTST system. In the process the corresponding product batch or quantity is subjected to an excessive thermal load often resulting in a flavour alteration which can be perceived by the consumer. In order to avoid a flavour impairment of the filled product it is customary before filling into containers for these over-pasteurised production phases or quantities to be mixed with normally treated product in the buffer store so that the filled product is devoid of any impairment as regards its flavour quality.

One of the disadvantages with known production installations however is that the buffer container which serves as a buffer store also exhibits a large diameter for a correspondingly tall height, and in particular a diameter which is many times greater than that of the entry and exit lines. This results in considerable disadvantages, especially when the product is food, especially beverages. Such production installations require regular thorough cleaning and/or disinfection or sterilisation of all elements of the production installation, and hence of the buffer store as well, that come into contact with the product. In order to clean the buffer store in the form of a buffer tank, the cleaning and/or sterilisation media must be introduced into the tank by way of spray nozzles and/or spray jets. In particular steps must also be taken to ensure that all areas of the tank's interior surface are cleaned, often even necessitating manual intervention with the opening of the buffer tank concerned so as in particular to also clean and/or disinfect and/or sterilise regions of the tank's interior surface which are hard to reach. The cleaning, disinfecting and sterilising of known buffer stores is consequently extremely time-consuming and expensive.

A further disadvantage is that known buffer stores must be approved and/or certificated as pressure vessels, which also occasions high costs.

The object of the invention is to provide a production installation which avoids the aforementioned disadvantages through at least one buffer store which can be cleaned, disinfected and sterilized without great expenditure of time in particular. A production installation including an apparatus for use in connection with filling liquid product into containers is configured to resolve this object.

It is a particularity of the invention that the buffer store and/or the interior of this store is formed by at least one tube or pipe, whereby to accommodate the tube length necessary for the storage volume, the tube is multiply coiled and/or bent and/or angled and, whatever the particular configuration of the tube, in such a way that there is a steady gradient inside the tube, and hence inside the buffer store, starting from a tube end or tube section which forms the top of the buffer store down to the bottom of the buffer store, or conversely in such a way that starting from a tube end or tube section which forms the base of the buffer store or a bottom outlet and/or inlet of the buffer store located there, the local height of this tube rises along the tube.

The invention is based on the knowledge that such a buffer store which, compared with conventional buffer stores, is not a boiler-like buffer tank and has a greatly reduced storage capacity, for example a maximum storage capacity of 500 litres, e.g. a storage capacity between only 50 and 500 litres, can fully perform the functions pertaining to a buffer store in a production installation provided it is monitored and/or controlled and/or regulated by suitable control and monitoring electronics, for example in the form of a control processor.

In this respect it is of particular benefit if for example inter alia the volumetric flow rate of the product from the installation for providing the product to the filling machine and the volumetric flow rate into the buffer store as well as the volumetric flow rate from the buffer store to the filling machine are measured and controlled or regulated.

In this respect it is of further particular benefit if the measured values obtained at different areas of the production installation, as well as in particular the machine parameters stored in a memory of the control processor and programme routines stored in the control processor, are taken into consideration.

The machine parameters stored in the memory of the control processor are for example characteristic values of the installation for providing the product and of the filling machine. For example the control characteristic and/or the response of the mixing installation 2 during startup or when changing the offtaken product quantity, for example as the number of litres of the product with a different composition following a change of the offtaken quantity by x %.

Or for example as a characteristic curve of the offtake quantity when starting the filling machine in litres per unit of time as a function of the time elapsed since the startup of the filling machine.

The values measured at the measuring points of the production installation are for example the current volumetric flow rate of the product at the exit from the installation for providing the product, the current volumetric flow rate of the product fed to the filling machine, the current pressure in the buffer store etc.

The inventive production installation and/or its buffer store offer significant advantages. The reduced storage capacity for example avoids an excessively long residence time of product quantities and hence possibly consequential qualitative impairments of the product. The tube which forms the buffer store can also be constructed with a cross-section that is equal to or at least roughly equal to the cross-section of the connections of the buffer store, thereby among other things avoiding regions inside the buffer store that are hard to reach for a cleaning and/or disinfection and/or sterilisation medium and making possible an optimal and simplified cleaning, disinfection and sterilisation of the buffer store, in particular without the need to open the buffer store and/or without dismantling elements of the buffer store. In particular it is possible to treat the buffer store as part of normal CIP cleaning and/or sterilisation and/or disinfection of the production installation. The cleaning and/or sterilisation and/or disinfection medium that is used can flow through the buffer store in a turbulent stream thereby achieving an intensive treatment. A further particular advantage is in the fact that the buffer store is not a pressure vessel that requires approval and/or certification but that the buffer store could be constructed from a tube material which is already approved for the maximum pressure that occurs in the production installation and/or buffer store.

Figure 2:
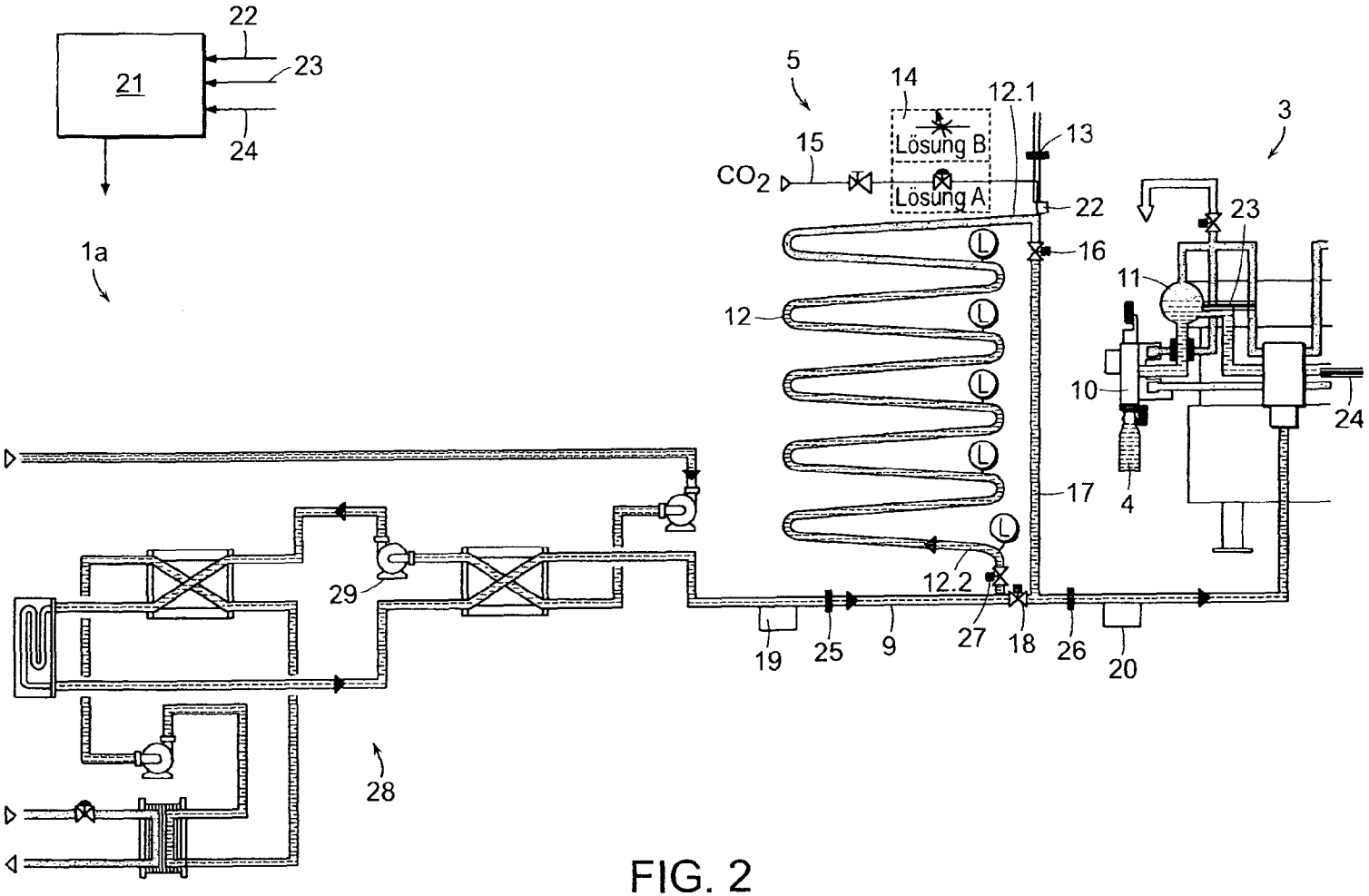
Figure 3:
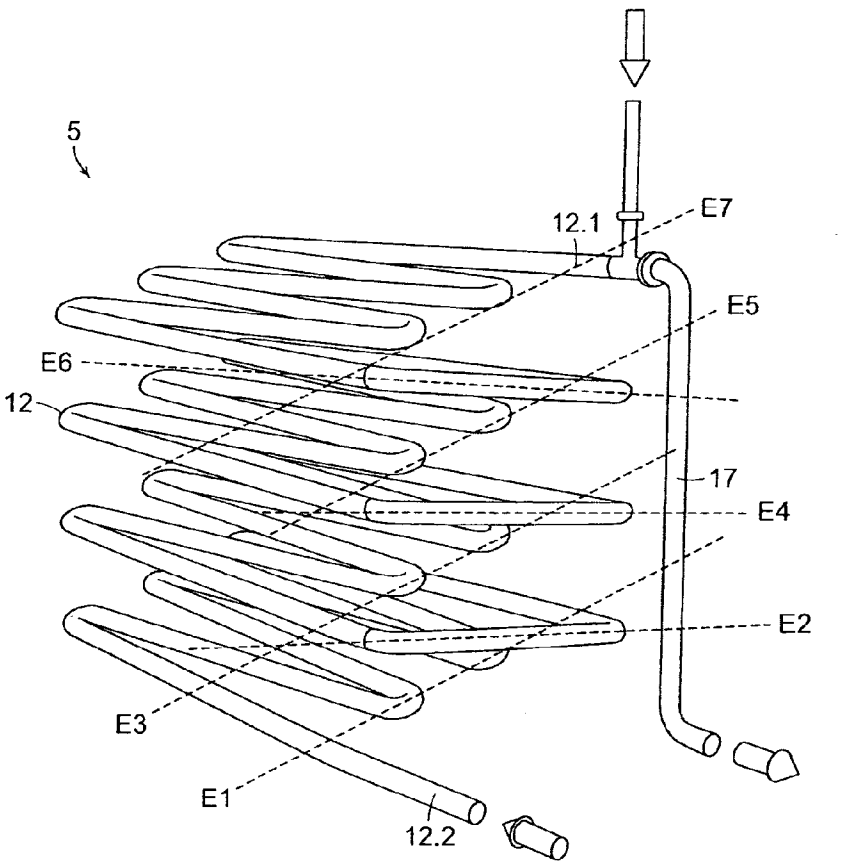

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or their cross-references. The content of the claims is also made an integral part of the description. The invention is explained in detail below through the use of embodiment examples with reference to the figures. In the figures:

FIGS. 1 and 2 each show a production installation for filling beverages into containers in the form of bottles;

FIG. 3 shows a simplified perspective single representation of the buffer store of the production installation illustrated in FIGS. 1 and 2.

The production installation generally indicated by 1 in FIG. 1 consists in the main of a mixing installation 2 for providing a beverage by mixing a flavour-forming component (syrup) and water with the addition of carbon dioxide, a rotary filling machine 3 for the filling of containers in the form of bottles 4 with the beverage produced in the mixing installation 2, and a buffer store 5 disposed in the product connection between mixing installation 2 and filling machine 3.

Mixing installation 2 has the configuration known to the person skilled in the art and comprises inter alia tanks 5 and 6 for providing water as main component and the flavour-forming component on a mixing section 8 on which the components are mixed and carbon dioxide is added to the resulting beverage. The exit from mixing section 8 is connected by a product line 9 with the filling machine and/or with filling material boiler 11 that is common to filling elements 10 of filling machine 3.

Buffer store 5 is connected to product line 9. The particularity of the buffer store 5 is in the fact that it is formed essentially only of at least one tube 12 which is multiply bent and/or wound and/or angled and/or coiled in such a way that this tube 12 exhibits a steady gradient starting from the top of buffer store 5 and/or from an upper tube end or tube section 12.1 located there, down to the base of buffer store 5 and/or to a tube end located there or to a tube section 12.2 located there. The length of tube 12 is selected so that buffer store 5 has the required storage capacity, this being greatly reduced compared with buffer tanks or buffer boilers normally used in production installations. The maximum storage capacity of buffer tank 5 is preferentially 500 litres or less and ranges for example from around 50 litres to 500 litres.

Buffer store 5 is connected to product line 9 by lower end 12.2. Upper end 12.1 is provided with a drain valve 13 and is connected by a control valve device 14 with a source 15 that provides an inert gas, for example nitrogen or CO2 gas under controlled pressure.

In addition, the upper end 12.1 of tube 12 is also connected to product line 9 by a vertical rising pipe 17 having a stop valve 16. A further stop valve 18 is provided in product line 9 between the connections of tube 12 and rising pipe 17. During the operation of production installation 1, buffer store 5 and/or its tube 12 is partly filled with the product (beverage) to the extent that a buffer cushion of the inert gas with a controlled pressure is present in the upper region of buffer store 5 inside tube 12. During the normal operation of production installation 1, valve 18 is open and valve 16 is closed.

In production installation 1, buffer store 5 serves inter alia as a buffer during the startup of production installation 1 and/or of mixing installation 2, whose product at startup may not yet exhibit the necessary mixing ratio of water and flavour-forming additive and is therefore initially stored in buffer store 5 and is then drawn from buffer store 5 during the ongoing operation of production installation 1 and, in product line 9, is proportionally added to or mixed with the product that is provided with the correct mixture or recipe by mixing installation 3, such that the product that is filled in bottles 2 satisfies the requirements including requirements as to flavour.

Buffer store 5 also serves inter alia to compensate volume fluctuations, including in particular pulse-like volume fluctuations, in the product that is provided by mixing installation 2 and/or offtaken by filling machine 3 in order to avoid an impairment of the filling process of filling machine 3 caused by such fluctuations. The buffer store also serves to compensate or at least mitigate effects on the product flow of startup and shutdown phases and of changes of production rate of filling machine 3. Buffer store 5 also serves in particular to equalise differential volumes between the product volume provided by mixing installation 2 and the product volume offtaken by filling machine 3.

In order for buffer store 5 to be able to perform these and other tasks despite its relatively small storage capacity, the most accurate possible monitoring, control and/or regulation of the components of production installation 1 and of buffer store 5 in particular is necessary. To this end are provided inter alia in product line 9, a flow meter 19 in the direction of flow downstream of the outlet of mixing installation 2, which meters the volumetric flow rate of product delivered by mixing installation 2, and a further flow meter 20 in the direction of flow downstream of buffer store 5 and upstream of filling machine 3, which meters the volumetric flow rate of product supplied to filler 3.

In another particularly advantageous embodiment of the present invention, a further flow meter 30 is positioned at the lower end of buffer store 5. This flow meter 30 allows the volume of liquid flowing into or out of buffer store 5 to be measured independently of the other fluid flows.

The measuring signals of flow meters 19 and 20 and/or 30 that correspond to the volumetric flow rate are passed to a controller and/or control processor 21 together with other measured values or measured parameters of measuring transmitters or measuring probes, inter alia of a pressure sensor 22 provided at upper end 12.1 of tube 12 and capturing the pressure in buffer store 5, of a sensor 23 capturing the fill level and pressure in filling material boiler 11 of filling machine 3, and of a sensor 24 capturing the rotational speed of the rotor of filling machine 3 and with it the current production rate of the filling machine (filled bottles 4 per unit of time multiplied by the volume of each bottle 4).

Knowing the exact fill level of buffer store 5 at any time is also advantageous. The fill level of buffer store 5 can for example be determined by continuously calculating the fluid streams flowing to or from buffer store 5, or also by fill level sensors attached to buffer store 5. It is moreover also possible to provide at the lower end of buffer store 5 a reversible pump with high accuracy of the volumetric flow rate delivered per revolution or working cycle, for example a proportioning pump, which makes it possible to feed or withdraw precisely defined liquid volumes to or from buffer store 5 respectively. The pressure-controlled filling and/or emptying of buffer store 5 can be completely replaced, or at least effectively assisted, by providing a proportioning pump. The time needed to fill/empty the buffer store can also be reduced.

Taking into account the above mentioned and other measured variables or parameters as well as data, parameters and/or programme routines stored in a memory of control processor 21, control processor 21 generates electrical control variables for controlling or regulating production installation 1 and in particular for controlling valves 25-27, of which valve 25 is provided in product line 9 in the connection between the exit from mixing installation 2 and buffer store 5, valve 26 in product line 9 in the connection between buffer store 5 and filling machine 3, and valve 27 at the outlet and inlet of buffer store 5.

Thus among other things, the pressure of the inert gas buffer in the upper region of pressure store 5 is set to the required value by control processor 21 on the basis of the measured signal supplied by pressure sensor 22. Moreover, at the startup of production installation 1 and/or mixing installation 2, and taking into consideration the known parameters stored in the memory of control processor 21, in particular as they relate to the control response of mixing installation 2, the product provided by mixing installation 2 is initially introduced into buffer store 5 until it is to be assumed that mixing installation 2 is delivering product with the nominal recipe at its outlet. The proportioned admixture of the product phase that is stored in buffer store 5 and that may not conform to the nominal recipe is then effected by appropriate triggering of control valve 27 and/or by appropriate setting of the pressure of the inert gas buffer in buffer store 5 and/or by suitable triggering of the proportioning pump.

Control processor 21 can very accurately determine the product volume present at any one time in buffer store 5 on the basis of the volumetric flow rates from mixing installation 2 to buffer store 5 and from buffer store 5 to filling machine 3 as measured by flow meters 19 and 20.

Alternatively or additionally, the product volume present in buffer store 5 can also be determined by flow meter 30 and by continuous calculation by control processor 21.

From the various measured values and other parameters stored in control processor 21, for example from stored parameters and/or characteristic curves of mixing installation 2 and of filling machine 3, control processor 21 generates the control variables in the described form inter alia for controlling and/or regulating the volumetric flow rate in product line 9, from product line 9 to buffer store 5, from buffer store 5 to product line 9 and/or to filling machine 3 and to therein located filling material boiler or filling product boiler 11 etc. Amongst other things, control valves 25-27 which are triggered by control processor 21 are provided for this purpose. By triggering in particular these control valves and/or proportioning pump 31, the above mentioned functions of buffer store 5 can be achieved controlled by control processor 21.

Programme defaults or programme routines are also stored in control processor 21 preferentially for controlling the various different operating states of production installation 1 and in particular of buffer store 5, and in particular for feeding in and bringing out the product or differential volumes of this product into and/or out of buffer store 5.

FIG. 2 shows as a further embodiment a production installation 1*a* whose only essential difference from production installation 1 is that instead of mixing installation 2, a high-temperature/short-time system 28 (HTST system hereinafter) that provides the product at its exit is provided for pasteurising the product. Production installation 1*a* serves to process and/or fill products and/or beverages, for example beer, which are pasteurised in order to increase their shelf life.

Regarding construction and function, HTST system 28 corresponds for example with pasteurizers known to the person skilled in the art. In the case of production installation 1*a*, buffer store 5 serves inter alia to temporarily store product quantities which, for example during an outage of filling machine 3, exhibit an impaired flavour quality as a consequence of a lengthy residence time in HTST system 28, with these product quantities with impaired flavour quality that are buffered in buffer store 5 during the ongoing process then being proportionally added under the control of control processor 21 to the product with the nominal quality in such an amount that a reduction in quality in the product filled in bottles 4, including in particular as regards flavour, cannot be detected.

In the case of production installation 1*a*, control processor 21 also delivers at least one control variable for regulating and/or controlling HTST system 28, in particular also for controlling the volumetric flow rate at the exit from this installation, for example by appropriately triggering a product delivery pump 29. Buffer store 5 in production installation 1*a* otherwise also performs the other functions described above in relation to production installation 1, doing so by appropriate triggering of production installation 1*a* and in particular of the various control valves 25-27 as a function of the measured values or parameters supplied to control processor 21 and taking into consideration data, parameters and/or programme defaults or programme routines stored in control processor 21.

Even taking the reduced storage capacity of buffer store 5 into account, configuring buffer store 5 as multiply bent and/or coiled tube 13 of sufficient length without parallel runs etc. achieves inter alia a shorter residence time of the product quantities placed in buffer store 5, thereby avoiding product quantities or product volumes which remain in buffer store 5 over a longer period of time and whose flavour quality for example could be impaired. Configuring buffer store 5 in the form of tube 12 also provides a much improved opportunity for cleaning and/or sterilising and/or disinfecting the interior of buffer store 5. This can be accomplished by the use of basically all known methods which have proven to be effective in the internal cleaning and/or internal sterilisation and/or internal disinfection of pipes.

FIG. 3 shows buffer store 5 again as a perspective single representation in which stop valve 16 in additional rising pipe 17 has been omitted for the sake of simplicity. As shown in FIG. 3, tube 12 which constitutes buffer store 5 is formed so that it creates, in each of a plurality of vertically consecutive levels E1-En, a multiply coiled and/or meander-like tube section which continues in the corresponding tube section of the next following level, whereby in order to achieve the steady gradient within buffer store 5 the individual levels E1-En are inclined so that two vertically consecutive levels E1-E2, E2-E3 etc. each enclose an angle of less than 90° in such a way that the inclination in each level E1-En corresponds to the direction of flow of the product from top to bottom within the buffer store 5. In the illustrated embodiment, the number n of levels is seven.

The described embodiment of the buffer store also and in particular ensures that the medium used for cleaning and/or sterilising flows through not only buffer store 5 and/or its tube 12 but also the associated rising pipe 17 in a turbulent stream, with the result that this alone ensures an optimal cleaning and/or sterilisation success. In particular, it is possible to include buffer store 5 in a CIP cleaning and/or sterilisation and/or internal disinfection of production installation 1 and/or 1*a* and of their interconnecting pipes, this being effected by closing valve 18 and opening valve 16 to allow the cleaning and/or sterilisation medium and/or disinfection medium flowing through product line 5 to also flow through buffer store 5 and/or its tube 12 with the inclusion of rising pipe 17 as well. Drain valve 13 at the upper end 12.1 of buffer store 5 is for example opened at least for a short time to allow total venting and avoid dead spaces not reached by the cleaning and/or sterilisation medium.

Further advantages of buffer store 5 consist in the fact that it essentially requires no acceptance and/or certification as a pressure vessel because buffer store 5 is fabricated using tubes and/or tube sections which already carry the appropriate approval for the maximum pressure present in buffer store 5 during operation.

The general gradient exhibited by tube 12 from upper tube end 12.1 down to lower tube end 12.2 ensures that buffer store 5 can be completely drained, for example at the end of a production run and/or before and after cleaning and/or sterilisation and/or disinfection of production installation 1 and/or 1*a*.

The invention has been described hereinbefore by reference to embodiments. It goes without saying that numerous variations as well as modifications are possible without departing from the inventive concept underlying the invention.

It has been hitherto assumed that buffer store 5 is formed by the single tube 12. It is of course equally possible for buffer store 5 to be executed in such a way that its interior is constituted by at least two tubes which in regard to function are provided parallel to one another at product line 9 between the device which provides the product, namely for example mixing installation 2 or HTST system 28, and filling machine 3.

It goes without saying that in a configuration of buffer store 5 comprising at least two functionally parallel tubes, each of these tubes 10 is provided at least with one control valve 27 of its own. In particularly advantageous embodiments, all parallel tubes each have a complete identical set of instrumentation and control elements and pumps.

For the sake of simplicity it has hitherto been assumed that tube section 12 forming buffer store 5 is a continuous section of tube from upper tube end 12.1 to lower tube end 12.2. Tube 12 can of course also be composed of a plurality of individual tubes or of a plurality of tube sections, for example of a plurality of tube sections which are each the tube sections disposed in levels E1-En.

The applicant's company has coined the term "Dynamischer Rohrbündelpuffer" (dynamic tube bundle buffer) for the present innovation.

REFERENCE LIST

1, 1*a* Production installation
2 Mixing installation
3 Filling machine
4 Bottle
5 Buffer store
6, 7 Tanks of mixing installation 2
8 Mixing section
9 Product line
10 Filling element
11 Product or filling material boiler
12 Tube
12.1 Upper tube end
12.2 Lower tube end
13 Drain valve
14 Control valve
15 Source for pressurised inert gas
16 Stop valve
17 Rising pipe
18 Stop valve
19,20 Flow meter
21 Control processor
22 Pressure sensor
23 Level and pressure sensor
24 Sensor for measuring the rate of filling machine 3

25, 26, 27 Control valve
28 HTST system
29 Product pump
30 Flow meter
31 Proportioning pump
E1-E7 Level

The invention claimed is:

1. An apparatus for use in connection with filling liquid product into containers, said apparatus comprising:

a buffer reservoir, said buffer reservoir comprising an upper end and a lower end that defines one of an intake and a discharge of said buffer reservoir, and a pipe that extends between said upper end and said one of an intake and a discharge of said buffer reservoir, wherein said pipe follows a twisted path between said upper end and said one of an intake and a discharge of said buffer reservoir, wherein said twisted path comprises at least one of numerous bends, numerous windings, and numerous twists, wherein said pipe has an upper section that forms said upper end of said buffer reservoir, wherein said pipe has a lower section that forms said lower end of said buffer reservoir, wherein said pipe comprises an interior space, wherein said interior space of said pipe forms a product space, and wherein said pipe has a continuous slope from said upper section to said lower section.

2. The apparatus of claim 1, further comprising a facility for supplying said liquid product, said facility comprising a filling machine for filling containers with said liquid product, and a first product supply line connecting said filling machine to said buffer reservoir.

3. The apparatus of claim 2, further comprising a second product supply line, wherein said second product supply line connects said pipe at said upper section thereof to said first product supply line.

4. The apparatus of claim 2, further comprising a stop valve in said product supply line, said stop valve being disposed between said one of an intake and a discharge of said buffer reservoir and a point at which said second supply line connects to said first supply line.

5. The apparatus of claim 2, wherein said pipe extends vertically upward from said lower section.

6. The apparatus of claim 2, wherein said pipe is connected to a source of pressurized inert gas at said upper section thereof, thereby enabling formation of a pressurized inert gas buffer.

7. The apparatus of claim 2, further comprising a control valve at said one of an intake and a discharge of said buffer reservoir for controlling product flow between said pipe and said product supply line.

8. The apparatus of claim 2, further comprising a pump at said one of an intake and a discharge of said buffer reservoir.

9. The apparatus of claim 2, further comprising a flow meter at said one of an intake and a discharge of said buffer reservoir.

10. The apparatus of claim 2, wherein said pipe is configured such that a continuous increase in elevation of said pipe occurs between said lower section and said upper section.

11. The apparatus claim 2, said facility is selected from the group consisting of a mixing facility for mixing a liquid product that has plural components, a filtering facility, and a flash pasteurizing facility.

12. The apparatus of claim 2, further comprising a control computer for regulating a parameter based on measurement values supplied to said control computer, wherein said parameter is selected from the group consisting of volumetric flow of said liquid product from said facility for supplying said liquid product to said filling machine, volumetric flow of said liquid product in said buffer reservoir, volumetric flow of said liquid product from said buffer reservoir to said filling machine, pressure in said buffer reservoir, and pressure in said filling machine.

13. The apparatus of claim 2, wherein said pipe comprises a first pipe section that extends along a first inclined plane and a second pipe section that extends long a second inclined plane, wherein said first and second inclined planes are successive inclined planes.

14. The apparatus of claim 13, wherein said first and second inclined planes form an acute angle relative to one another.

15. The apparatus of claim 2, wherein said pipe comprises numerous pipe sections.

16. The apparatus of claim 2, further comprising additional buffer reservoirs connected to said product supply line.

17. The apparatus of claim 1, further comprising a second product supply line, wherein said second product supply line connects said pipe at said upper section to said first product supply line.

18. The apparatus of claim 1, further comprising a stop valve in said product supply line between said one of an intake and a discharge of said buffer reservoir and a point at which said second supply line connects to said first supply line.

19. The apparatus of claim 1, wherein said pipe extends vertically upward from said lower section.

20. The apparatus of claim 1, wherein said pipe is connected to a source of pressurized inert gas at said upper section thereby enabling formation of a pressurized inert gas buffer.

21. The apparatus of claim 1, further comprising a control valve at said one of an intake and a discharge of said buffer reservoir for controlling product flow between said pipe and said product supply line.

22. The apparatus of claim 1, further comprising a pump at said one of an intake and a discharge of said buffer reservoir.

23. The apparatus of claim 1, further comprising a flow meter at said one of an intake and a discharge of said buffer reservoir.

24. The apparatus of claim 1, wherein said pipe is configured such that a continuous increase in elevation of said pipe occurs between said lower section and said upper section.

25. The apparatus of claim 1, wherein said pipe comprises a first pipe section extending along a first inclined plane and a second pipe section that extends long a second inclined plane, wherein said first and second inclined planes are successive inclined planes.

26. The apparatus of claim 25, wherein said first and second inclined planes form an acute angle relative to one another.

27. The apparatus of claim 1, wherein said pipe comprises numerous pipe sections.

* * * * *